US005910006A

United States Patent [19]

Conroy et al.

[11] Patent Number: 5,910,006

[45] Date of Patent: Jun. 8, 1999

[54] KILN LID MOUNTING ASSEMBLY

[75] Inventors: Michael D. Conroy, 4696 Trading Post Tr. S., Afton, Minn. 55001; Jay A. Johnson, 2269 Lake Elmo Ave. North, Lake Elmo, Minn. 55042; Claude E. Cybulski; Eric R. Cybulski, both of Lake Elmo, Minn.

[73] Assignees: Michael D. Conroy, Afton; Jay A. Johnson, Lake Elmo, both of Minn.

[21] Appl. No.: 08/864,882

[22] Filed: Jun. 1, 1997

[51] Int. Cl.[6] ..... F27D 1/18

[52] U.S. Cl. ..... 432/250; 432/251

[58] Field of Search ..... 432/250, 160, 432/195, 251

[56] References Cited

U.S. PATENT DOCUMENTS

| | | | |
|---|---|---|---|
| 3,958,923 | 5/1976 | Duncan | 432/250 |
| 5,477,029 | 12/1995 | Skutt et al. | 432/250 |

OTHER PUBLICATIONS

A sales catalog, identified as "Paragon Kilns, Catalog No. 37" from Paragon Industries, Inc., 2011 South Town East Blvd, Mesquite, Texas 75149–1I22 having a 1991 copyright.

A sales bulletin identified as "Bulletin:XT–6–69" titled "Da Vinci, The Production Kiln" from L and L Kiln Mfg., Inc. 6B Mt. Pleasant Drive, P.O. Box 2409, Aston, PA 19014.

A sales bulletin identified as "Bulletin No C–6–69" titled "Mini–Catalog" from L and L Kiln Mfg., Inc. 6B Mt. Pleasant Drive, P.O. Box 2409, Aston, PA 19014.

*Primary Examiner*—John A. Jeffery
*Assistant Examiner*—Jiping Lu
*Attorney, Agent, or Firm*—William L. Huebsch

[57] ABSTRACT

An assembly for use in mounting a lid on a kiln body. An anchor member is mounted on a side surface of the kiln body defined by a metal outer layer of the body, which anchor member has a horizontal pivot pin fixed adjacent its upper end. Spaced hinge portions are attached to the periphery of the lid and have surfaces defining through openings receiving and being pivotable about the pivot pin, including generally vertically extending surfaces that afford vertical movement of the lid relative to the pivot pin to accommodate vertical expansion of a ceramic lining in the kiln during heating of the kiln. The assembly also includes a force transfer structure including (1) a pivot portion pivotably mounted on the pivot pin and projecting from the pivot pin along the periphery of the lid and above the upper surface of the lid, and (2) a transverse portion attached to an upper part of the pivot portion. That transverse portion has a lid bridging part spaced above the upper surface of the lid and having a distal end attached along the periphery of the lid at a location opposite the pivot portion to afford pivoting of the lid relative to the transverse portion about an axis parallel to that of the pivot pin. The transverse portion also has a force receiving part projecting from the side of the upper part opposite the lid bridging part and having a distal end to which is attached one end of a tensioned spring having its opposite end attached to the anchor member. That spring applies a force to assist manual lifting of said lid through the pivotably attached end of the transfer portion in a way that does not interfere with movement of the lid during heating and cooling of the kiln.

20 Claims, 4 Drawing Sheets

KILN LID MOUNTING ASSEMBLY

FIELD OF THE INVENTION

The present invention relates to assemblies adapted to mount the ceramic lids on the ceramic lined bodies of kilns of the type called "hobby kilns".

BACKGROUND

One type of kiln often used by finished ware manufactures to fire low fired and high fired ceramic products is called a "hobby kiln" (e.g., the 3 to 11 cubic foot, 8, 10 or 12 sided "hobby kilns" sold under the trade designation "Paragon Touch n Fire(trade mark)" by Paragon Industries, Inc., Mesquite, Tex.; sold as models 818 through 1227-3 by Skutt Kiln Company, Portland, Oreg.; sold as models S18 through 3027 oval by Olympic, Atlanta, Ga.; and sold as models 1728 through 3536 by Aim's Kiln, San Diego, Calif.). While such "hobby kilns" can not fire the quantity of products that can be fired in industrial kilns, they provide the advantage of firing a smaller amount of products in about a 24 hour time period, which makes them more versatile for use in some production situations. Such "hobby kilns" include a body having an outer side surface defined by a layer of sheet metal, a ceramic lining having an upper surface and defining a chamber recessed from and opening through that upper surface, which chamber is adapted to receive ceramic objects to be cured. The kiln also includes a lid adapted, when closed, to rest on that upper surface and to extend across the opening. That lid includes a layer of ceramic material defining upper and lower surfaces for the lid, and a metal strap or binding member tensioned around the layer of ceramic to retain the ceramic material in the layer, define the periphery of the lid, and provide a structure to which related hardware can be fastened. Electrically operated or gas fired means are provided for heating the chamber so that, with the lid supported on the upper surface of the body, green or glazed ceramic can be cured within the chamber. Such heating causes expansion of the ceramic lining relative to the layer of sheet metal, including in the vertical direction. The kiln includes a hinge assembly mounting one side of the lid on one side of the layer of sheet metal of the body, which hinge assembly affords pivoting the lid around a pivot pin carried by the lid from its closed position to an open position spaced from the top surface of the body. That hinge assembly typically allows movement of the pivot pin vertically in slots in a portion of the hinge assembly mounted on the body so that the lid can move vertically relative to the layer of sheet material of the body to accommodate expansion of the ceramic lining during heating of the kiln. Such lids are heavy because of the quantity of ceramic material they include, require a high initial lifting force applied at an inconvenient height above the floor on which the person lifting the lid is typically standing (e.g., at a height of about three and one half feet for a seven to ten cubic foot kiln), and typically require the person opening the lid to change his hand position while leaning over the body during opening of the lid (e.g., in the fully open position of the lid the lid handle at the front of the lid is at a height of over six feet and is over the top of the body about 22 inches from the front of the body). Consequently, the lids are frequently dropped while partially open, which can injure the person opening the lid, and often results in breakage of the ceramic material in the lid or body so that repair of the kiln is required. Such lids on some kilns are moved to an open position where the center of gravity of the lid is on the side of the pivot pin opposite the body, and are retained in that open position by lengths of chain tensioned between opposite sides of the body and corresponding opposite sides of the lid. Tension on the chains in this position can deform the ceramic lining in the body, changing it from round to oval so that it repair is required. The chains can get in the way of loading and unloading the kilns. Also, a person can inadvertently hit one of the chains and cause the lid to close unexpectedly so that it can either strike the person using the kiln or can crash onto the body of the kiln. Such lids on other kilns are moved to an open position where the center of gravity of the lid is over the body, and are retained in that position by a mechanical two bar linkage between the lid and the body on one or both sides of the kiln. Those two bar linkages can get in the way of loading and unloading the kilns. Also, it is sometimes difficult to insure that the two bars of such linkages are locked together in their open position and a person can inadvertently move such linkages, thereby allowing the lid to close unexpectedly. These problems are particularly severe for kilns that are over 7 cubic feet in chamber size where the lids can weigh over 60 pounds and are over 34 inches in diameter.

DISCLOSURE OF THE INVENTION

The present invention provides an improved assembly for use in mounting a lid on a body of a kiln of the type described above, which assembly counterbalances the lid to allow it to be easily moved between its open and closed positions, significantly reduces the force with which the lid will strike the body should it be dropped while partially open, retains the lid at its open position without applying a force to the body that tends to deform it, and still allows sufficient freedom of movement for the lid so that it will stay in its closed position on the top surface of the body as the ceramic liner in the body expands and contracts during the heating and cooling cycle of the kiln.

The assembly according to the present invention, when attached to a kiln, includes an anchor member mounted on the layer of sheet metal defining the side surface of the body of the kiln, a horizontal pivot pin mounted on the anchor member adjacent its upper end, and spaced hinge portions attached to the periphery of the lid having surfaces defining through openings receiving and being pivotable about the pivot pin. Those surfaces include (when the lid is closed) generally vertically extending surfaces having sufficient length to afford vertical movement of the hinge portions and lid relative to the pivot pin to accommodate expansion of the ceramic lining relative to the layer of sheet metal during heating of the kiln by the heating means. The assembly also includes a force transfer structure including (1) a pivot portion having a lower end part pivotably mounted on the pivot pin, which pivot portion projects from the pivot pin along and above the periphery of the lid, and (2) a transverse portion attached to an upper part of the pivot portion. That transverse portion has a lid bridging part projecting from the upper part, spaced above the upper surface of the lid, and having a distal end positioned and attached along the periphery of the lid at a location opposite the pivot portion by means that affords pivoting of the lid relative to the force transfer structure around an axis parallel to the axis of said pivot pin. The transverse portion also has a force receiving part projecting from the side of the upper part opposite the lid bridging part and having a distal end spaced from the pivot portion. Biasing means (e.g., a coil spring) is coupled between the distal end of the force receiving part and the anchor member and applies force (1) to assist manual lifting of the lid at the distal end of the lid bridging part to move the lid from its closed position to an open position spaced from the upper surface of the body, and (2) to retain the lid at its open position. This structure allows independent movement of the lid relative to the force transfer structure so that it can remain in its closed position when the ceramic lining in the body expands and contracts during the heating and cooling cycle of the kiln by both vertical movement of the slotted hinge portions with respect to the pivot pin and pivoting of the lid relative to the force transfer structure at the side of the lid opposite the pivot pin, and yet allows the counterbalancing effect of the biasing means acting through the force transfer structure to help lift the lid and to retain in its open position. It is very important that the lid remain in its closed position when the ceramic lining in the body expands and contracts during the heating and cooling cycle of the kiln, as even a small gap between the lid and the top surface of the body can allow sufficient heat loss to prevent the kiln from reaching its proper temperature for curing the ceramics, as well as presenting a potential fire hazard to the surrounding area and a potential burn hazard to an operator of the kiln.

In a preferred embodiment of the assembly, the pivot pin has opposite end portions projecting from opposite sides of the anchor member, and the assembly includes a stabilizing part having opposite end portions each pivotably mounted on a different one of the projecting end portions of the pivot pin and having a central portion fixed to the distal end of the force receiving part. The assembly also includes a generally horizontal stop pin supported on the anchor member and having opposite end portions projecting from the sides of the anchor member in a position adapted to be engaged by the opposite end portions of the stabilizing member upon movement of the lid to its open position. In that open position of the lid the biasing means is adapted to apply a force sufficient to retain the end portions of the stabilizing part in engagement with the end portions of the stop pin in the absence of external forces applied to close the lid. That stop pin is of resiliently flexible material and is only supported at spaced locations adjacent its projecting end portions on the upper end portion of the anchor member. Engagement of the opposite end portions of the stabilizing member with the projecting opposite end portions of the stop pin will cause resilient deflection of the stop pin between those spaced locations to help absorb the momentum of and thereby cushion the lid as it stops against the stop pin in its open position.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
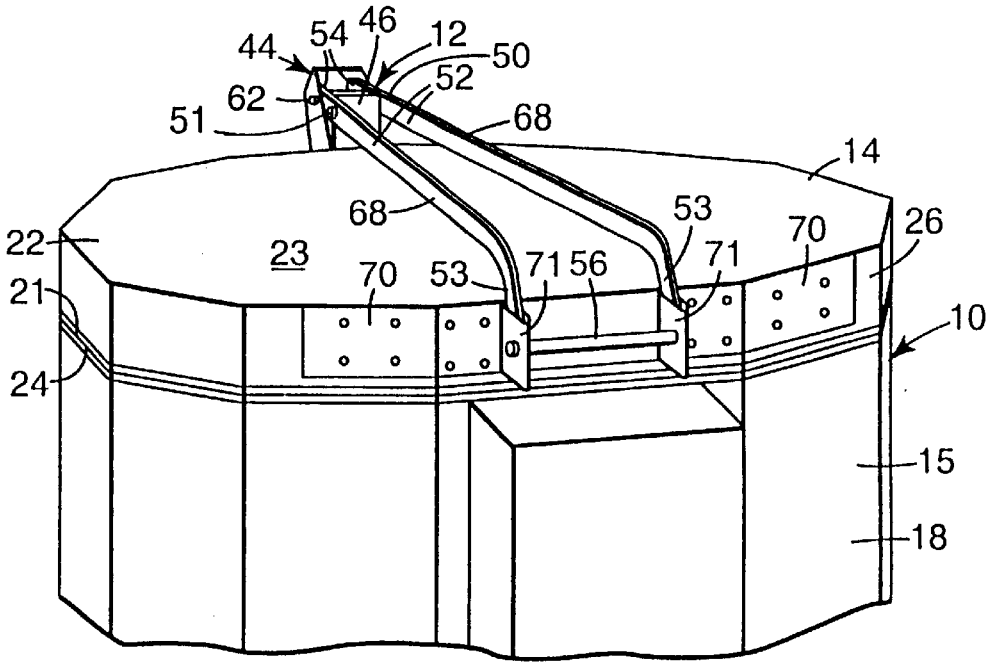
FIG. 1 is a fragmentary front, top, left side perspective view of a kiln including an assembly according to the present invention for mounting a lid on a body of the kiln in which the lid is shown in a closed position.

Referring now to the drawing there is illustrated a kiln 10 including an assembly 12 according to the present invention for mounting a lid 14 of the kiln 10 on a body 15 of the kiln 10.

Except for the assembly 12, the kiln 10 is of a well known type (e.g., a model TNF-28-3 Hobby Kiln make by Paragon Industries, Inc., Mesquite, Tex.). The body 15 has a normally vertically extending outer side surface 17 defined by a sheet of metal 18 around a ceramic lining 19 (e.g., two and one half to three inch thick lining) defining a chamber 20 recessed from and opening through an upper surface 21 of the body 15 that is defined by the lining 19 extending around the opening to the chamber 20. The chamber 20 is adapted to receive green or glazed ceramic objects, and the lid 14 is adapted to rest on the upper surface 21 of the body 15 and to extend across the opening to the chamber 20 in a closed position of the lid 14. The lid 14 comprises a layer of ceramic material 22 (e.g., 3 inch thick 4.5 inch by 9 inch ceramic bricks cemented together) having a peripheral surface (e.g., 8, 10, or 12 equal length flat surface portions around its periphery) and major upper and lower surfaces 23 and 24 defining the upper and lower surfaces of the lid 14. The lid 14 is held together by a binding member or metal band 26 tensioned around the peripheral surface of the ceramic material 22 to retain it in the layer. That metal band 26 defines the periphery of the lid 14. The kiln includes conventional electrically operated means including heating coils and electronic controls for heating the chamber 20 so that, with the lower surface 24 of the lid 14 supported on the upper surface 21 of the body 15, ceramic ware can be cured within the chamber 20. Such heating (e.g., to 2,300 degrees Fahrenheit for about 6 to 12 hours) causes expansion of the ceramic lining 19 relative to the sheet of metal 18 including in the vertical direction (e.g., vertical expansion of about 3/16 to ¼ inch for the model TNF-28-3 Hobby Kiln).

Figure 4:
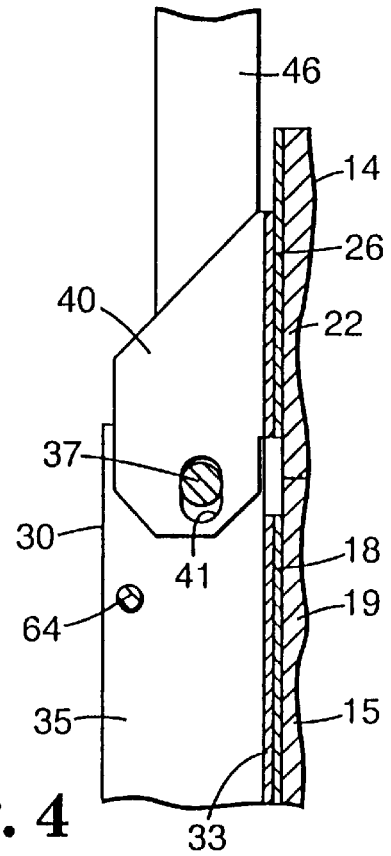
FIG. 4 is a fragmentary enlarged sectional view taken approximately along line 4—4 of FIG. 3.
Figure 5:
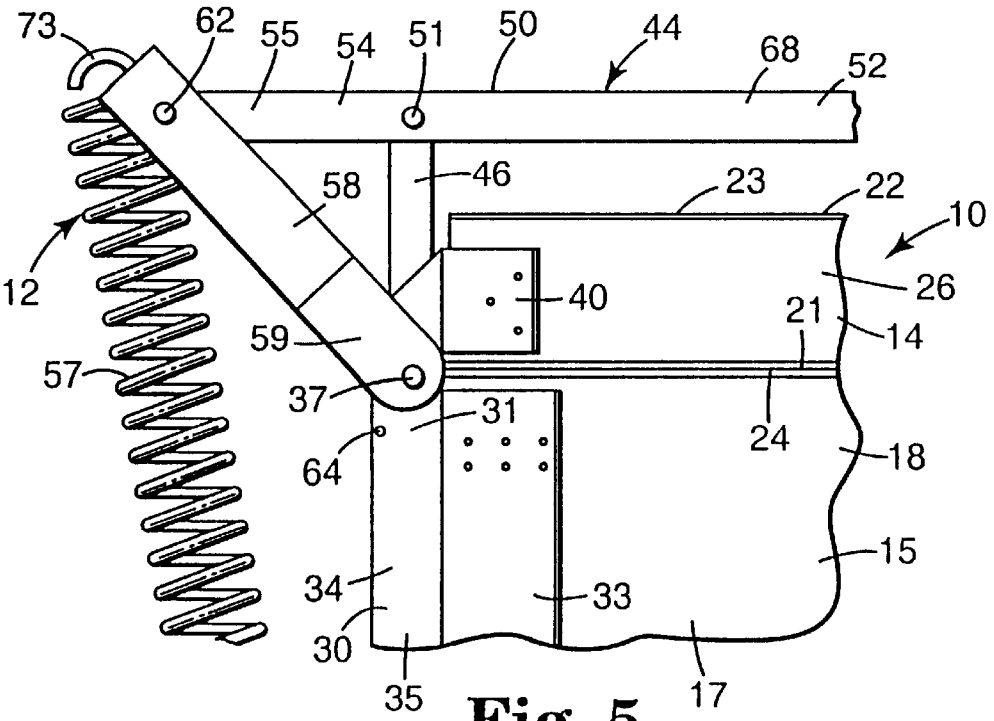
FIG. 5 is a fragmentary side view of the kiln of FIG. 1 that includes the assembly according to the present invention also shown with the lid in its closed position.

The assembly 12 according to the present invention that is adapted for mounting the lid 14 on the body 15 of the kiln 10 accommodates such expansion and the subsequent contraction during a heating cycle, applies a force that allows the lid to be easily opened, and can retain the lid in an open position. The assembly 12 comprises an anchor member 30 of formed of heavy sheet metal (e.g., 14 gauge or 0.074 inch thick steel) having opposite upper and lower ends 31 and 32, curved flanges 33 along its opposite edges extending between those ends 31 and 32, which flanges 33 are attached to the sheet of metal 18 defining the side surface of the kiln 10 by screws extending through the flanges 33 and the sheet of metal 18, and a generally U-shaped central portion 34. The central portion 34 projects away from the body 15 of the kiln 10, has opposite side parts 35 extending vertically between the ends 31 and 32 that are disposed at about a right angle with respect to the outer surface of the body 15 of the kiln 10, and has a central part 36 extending between those side parts 35 at a position spaced from the outer surface 17 of the body 15. A cylindrical pivot pin 37 is mounted in a fixed position on the anchor member 30 adjacent its upper end 31 with its axis generally horizontal by extending through both of the side parts 35. Two spaced hinge portions 40 are attached to the metal band 26 defining the periphery of the lid 14. The hinge portions 40 include radially projecting parts having surfaces defining openings 41 through the spaced hinge portions 40 that receive and are pivotable about the pivot pin 37 (see FIG. 4). The surfaces defining the openings 41 through the spaced hinge portions 40 comprise, with the lid 14 supported on the upper surface 21, opposed generally vertically extending opposed straight surfaces having sufficient length to afford vertical movement of the hinge portions 40 and the lid 14 relative to the pivot pin 37 to accommodate expansion of the ceramic lining 19 during heating of the kiln 10 by the heating means, and arcuate surfaces joining the upper and lower ends of those straight surfaces. The arcuate surface joining the upper end of those straight surfaces is positioned so that it will bear on the surface of the pivot pin 37 when the kiln 10 is at room temperature so that it can act as a bearing surface when the lid 14 is then pivoted to its open position about the pivot pin 37. It is very important that the lid 14 remain in its closed position when the ceramic lining in the body expands and contracts during the heating and cooling cycle of the kiln 10. The lid on the model TNF-28-3 Hobby Kiln described above will rise about ½ inch relative to the sheet of metal 18 and the anchor member 30 during the heating and cooling cycle of that kiln 10. If the elongate slot for the pivot pin 37 defined by the straight surfaces was not provided for that kiln 10 the front of the lid will open slightly when the kiln reaches about 500 degrees F., allowing sufficient heat loss that the kiln will be prevented from reaching its proper temperature for curing the ceramics, as well as presenting a potential fire hazard to the surrounding area and a potential bum hazard to an operator of the kiln.

The assembly 12 also includes a force transfer structure 44 that transfers force applied to help lift the lid from its closed to an open position in such a way that the applied force does not interfere with vertical movement of the lid 14 described above during the heating and cooling cycle of the kiln 10. That force transfer structure 44 comprises: (1) a pivot portion 46 having a lower end part pivotably mounted on the pivot pin 37, which pivot portion 46 projects from the pivot pin 37 along the periphery of the lid 14 and has an upper part spaced above the upper surface 23 of the lid 14, and (2) a transverse portion 50 attached by a pin 51 to the upper part of the pivot portion 46. The transverse portion 50 includes a lid bridging part 52 projecting from the upper part 49, spaced above the upper surface 23 of the lid 14, and having a distal end 53 positioned along the periphery of the lid 14 at a location opposite the pivot portion 46 and the pivot pin 37. The transverse portion 50 also has a force receiving part 54 projecting from the side of the upper part 49 opposite the lid bridging part 52 and having a distal end 55 spaced from the pivot portion 46. The assembly includes mounting means including a pin 56 adapted for mounting the distal end 53 of the lid bridging part 52 on the periphery of the lid 14 at the location opposite the pivot portion 46 and the pivot pin 37, which mounting means affords pivoting of the force transfer structure 44 relative to the lid 14 around an axis defined by the pin 56 that is parallel to the axis of the pivot pin 37. Also, the assembly 12 includes biasing means in the form of a spring 57 coupled between the distal end 55 of the force receiving part 54 and the anchor member 30 that is adapted for applying a force to assist manual lifting of the lid 14 at the distal end 53 of the lid bridging part 52 to pivot the force transfer structure 44 and the lid 14 about the pivot pin 37 to move the lid 14 from its closed position to an open position spaced from the upper surface 21. This "teeter totter" like force transfer structure 44 restricts binding of the hinge portions 40 on the pivot pin 37 during relative movement therebetween.

The assembly 12 includes a stabilizing part 58 having opposite end portions 59 each pivotably mounted on a different one of outwardly projecting end portions of the pivot pin 37 and a central portion fixed to the distal end 55 of the force receiving part 54 by a pin 62. While the assembly 12 could function without this stabilizing part 58, the stabilizing part 58 restricts twisting motion of the lid 14 as it is moved between its open and closed positions. Also, the stabilizing part 58 forms a rigid triangular structure in combination with the pivot portion 46 and the force receiving part 54, and provides part of means for defining an open position for the lid 14. The assembly 12 includes a generally horizontal stop pin 64 supported on the anchor member 30 and having opposite end portions projecting from its side parts 35 in a position adapted to be engaged by the opposite end portions 59 of the stabilizing part 58 upon movement of the lid 14 to an open position with the lid 14 projecting upwardly with its inner surface 24 at an included angle of about 67 degrees with respect to the upper surface 21 on the body 15. In the open position of the lid 14, much of the weight of the lid is supported on the pivot pin 37 and the biasing means or spring 57 is adapted to apply a force sufficient to retain the end portions 59 of the stabilizing part 58 in engagement with the projecting end portions of the stop pin 64 and the lid 14 in its open position in the absence of external forces applied to the lid 14 to close it. The stop pin 64 is of resiliently flexible material (e.g., 0.25 inch diameter spring steel) and is supported at only two spaced locations adjacent its projecting end portions on the anchor member 30. Engagement of the opposite end portions 59 of the stabilizing part 58 with the projecting opposite end portions of the stop pin 64 will cause resilient deflection of the stop pin 64 between those spaced locations to help absorb the momentum of the lid 14 and thereby cushion its deceleration as it reaches its open position defined by the stop pin 64. The stop pin 64 can be removed from the anchor member 30 to afford movement of the stabilizing part 58 and the force transfer structure 44 to a position with the lid 14 past the open position defined by the stop pin 64 and further spaced from the upper surface 21 than in that open position (e.g., to a position with the center of gravity of the lid 14 on the side of the pivot pin 37 opposite the body 15) should this be desired to load, unload, clean or repair the kiln 10, or to remove the spring 57.

Figure 2:
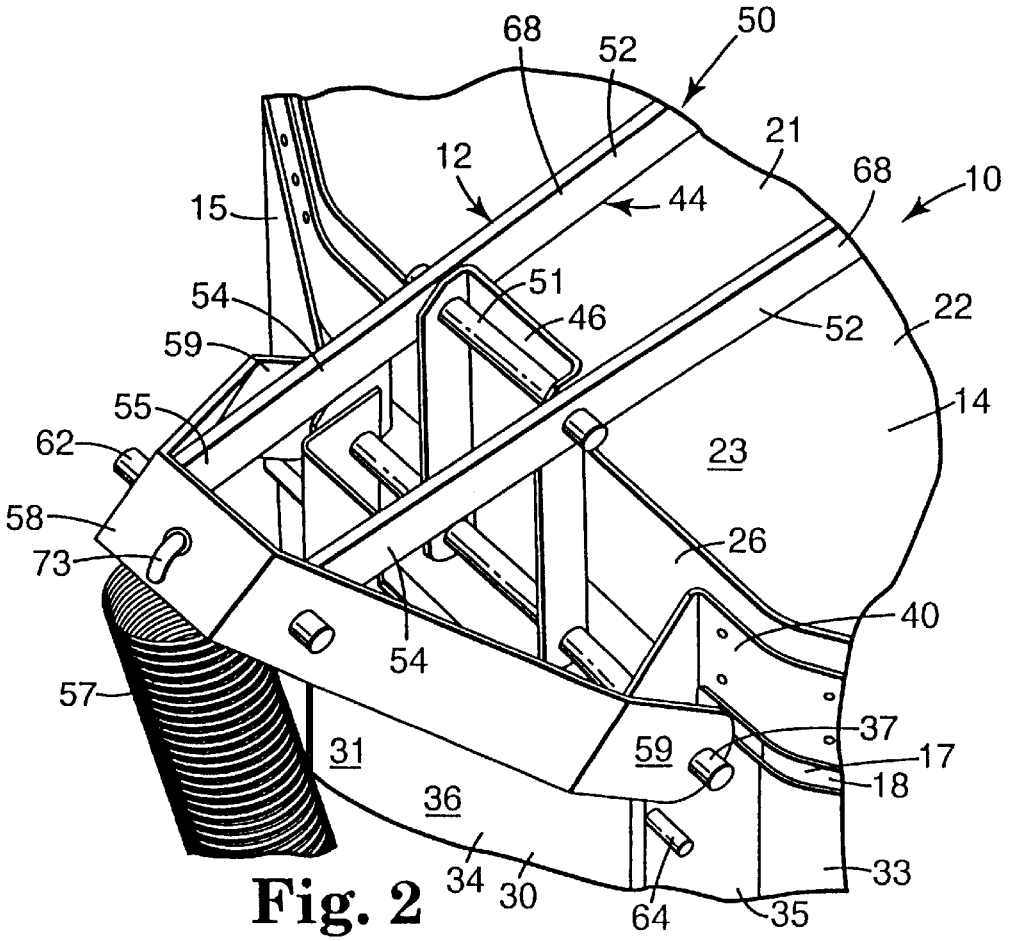
FIG. 2 is a fragmentary rear, top, right side perspective view of the kiln of FIG. 1 that includes the assembly according to the present invention in which the lid is also shown in its closed position.
Figure 3:
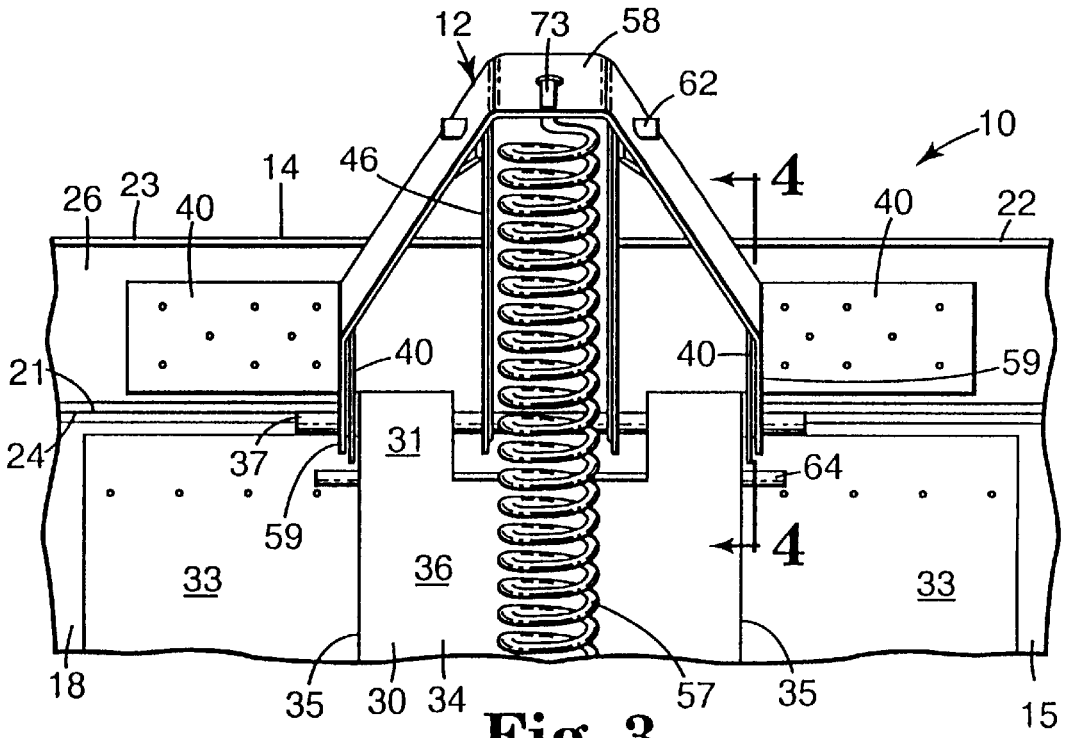
FIG. 3 is a fragmentary rear view of the kiln of FIG. 1 that includes the assembly according to the present invention also shown with the lid in its closed position.

As is best seen in FIG. 2, the pivot portion 46 of the force transfer structure 44 is a channel having a generally U-shaped cross section, and has opposite sides spaced axially of the pivot pin 37. The transverse portion 50 of the force transfer structure 44 comprises two elongate rigid bridging members 68 attached along opposite sides of the upper part of the pivot portion 46 by the pin 51. Different portions of the bridging members 68 on opposite sides of the pivot portion 46 provide the lid bridging and force receiving parts 52 and 54 of the transverse portion 50 and have distal ends providing the distal ends 53 and 55 of the lid bridging and force receiving parts 52 and 54.

Figure 6:
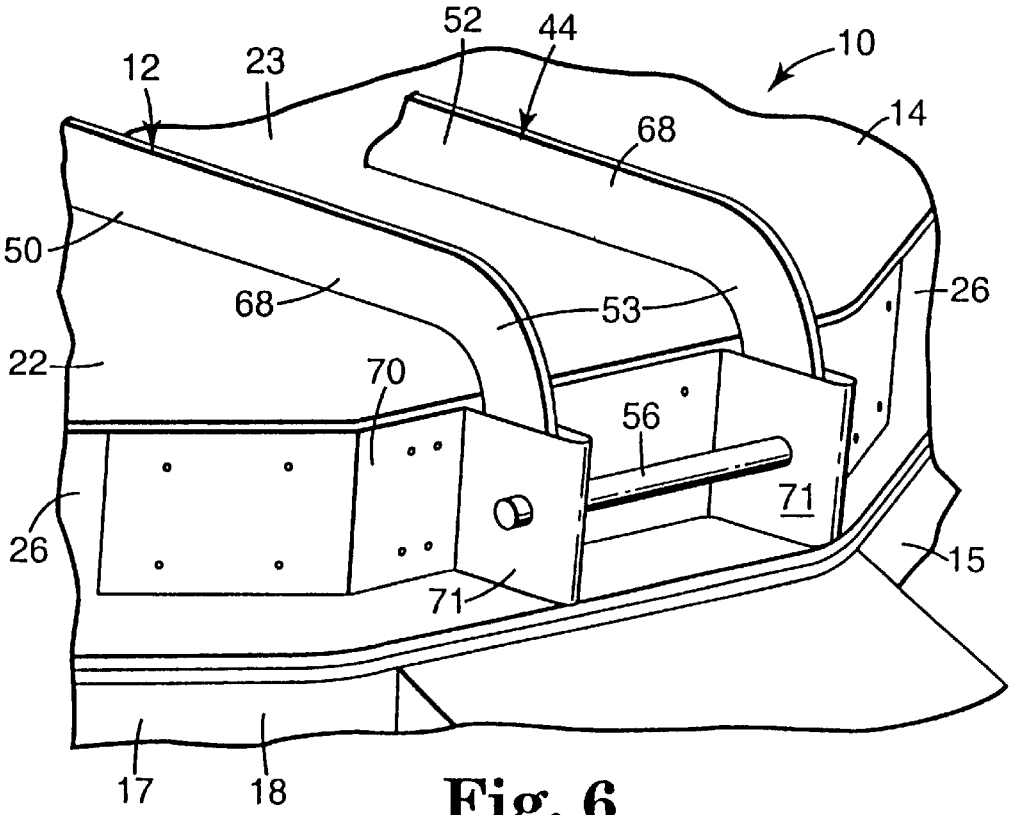
FIG. 6 is a fragmentary enlarged front, top, left side perspective view of the kiln of FIG. 1 that includes the assembly according to the present invention shown with the lid in the closed position.
Figure 7:
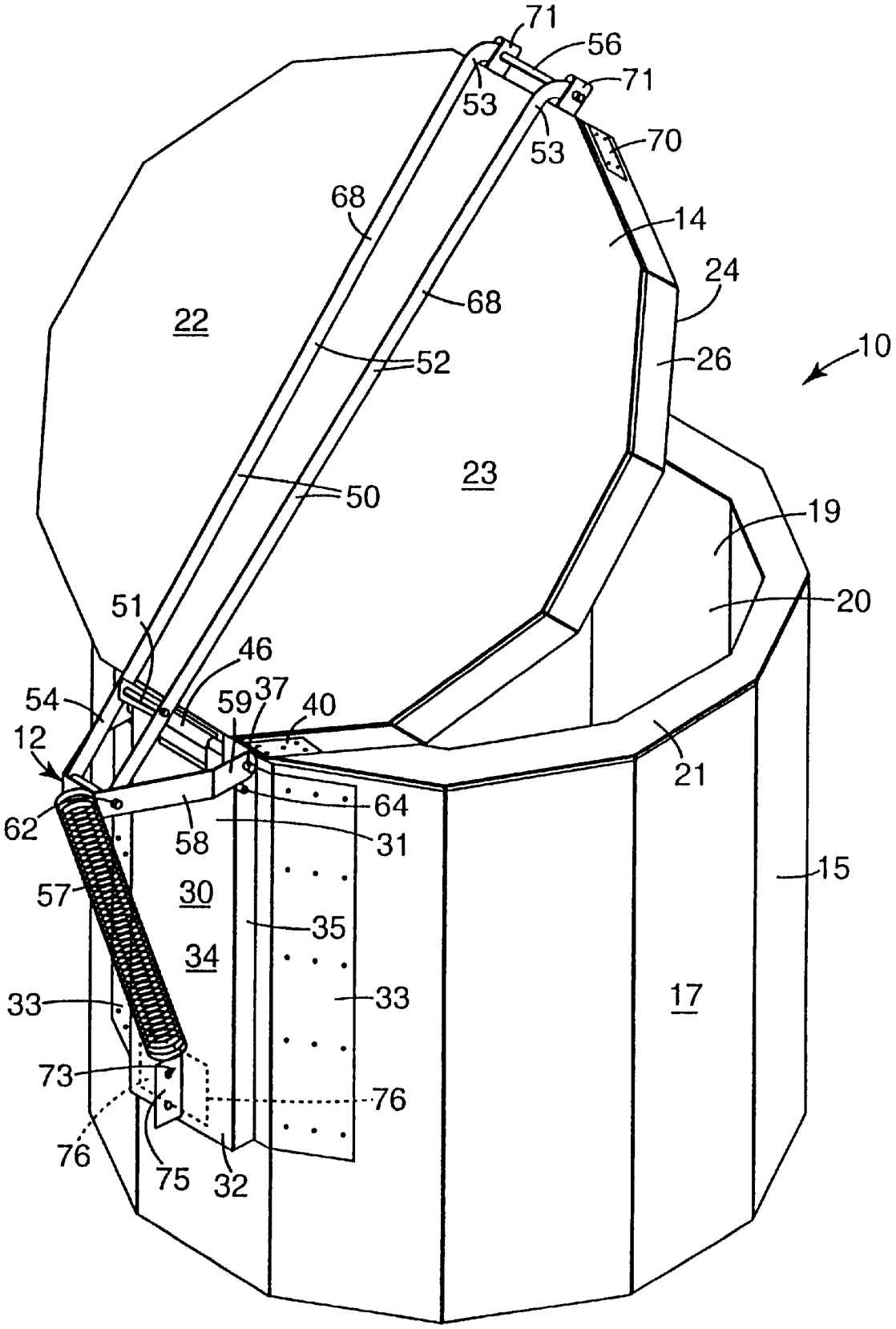
FIG. 7 is a rear, top, right side perspective view of the kiln of FIG. 1 that includes the assembly according to the present invention and is shown with the lid in an open position.

As is best seen in FIGS. 1 and 6, the means adapted for mounting the distal end 53 of the lid bridging part 52 on the periphery of the lid 14 at the location opposite the anchor member 30 comprises a bracket 70 attached by screws to the metal band 26 defining the periphery of the lid 14. The bracket 70 has two spaced projections 71 that project from the periphery of the lid 14, and means for pivotably mounting the adjacent arcuate distal ends 53 of the bridging members 68 on the projections 71 comprising the pin 56 that extends through the projections 71 and the adjacent distal ends 53 of the bridging members 68. A portion of that pin 56 between the projections 71 provides a handle adapted for manual engagement to move the lid 14 between its closed and its open position. The spacing of the two projections 71 causes the counterbalancing force applied by the two bridging members 68 to be applied at two spaced locations along the periphery of the lid 14 which reduces the stress applied to any one portion of the metal band 26 and underlying ceramic material, and also helps to transversely balance the lid 14 when it is open.

The biasing means or coil spring 57 coupled between the distal end 55 of the force receiving part 54 and the anchor member 30 has hooks 73 at its opposite ends. One of those hooks 73 extends through a central opening in the stabilizing part 58, whereas the other extends through an opening in a central part of a bracket 75 projecting through the anchor member 30 adjacent its lower end 32. That bracket 75 has flanges 76 projecting in opposite directions along the side of the anchor member 30 adjacent the body 15 to insure sufficiently firm attachment of the bracket 75 to the anchor member 30 to hold the end of the spring 57. As an example, the coil spring 57 can have forty seven coils 1.7 inches in diameter that have a non-stretched length of about 10 inches and a spring constant of about 11.3 pounds per inch, which coil spring 57 can be stretched to apply a tension of about 144.6 pounds when the lid 14 is closed, and a load of about 48.5 pounds when the lid 14 is open.

The present invention has now been described with reference to one embodiments thereof It will be apparent to those skilled in the art that many changes can be made in the embodiments described without departing from the scope of the present invention. For example, the biasing means coupled to the distal end of the force receiving part could be other than a spring, such as a weight, or a gas charged piston which could be in the form of a air or hydraulically operated cylinder which can be activated by a user of the kiln to open or close the lid. Thus, the scope of the present invention should not be limited to the structures and methods described in this application, but only by the structures and method described by the language of the claims and the equivalents thereof.

What is claimed is:

1. An assembly adapted for mounting a lid of a kiln on a body of the kiln, said body having a normally vertically extending and a normally horizontal upper surface and comprising a ceramic lining defining said upper surface and a chamber recessed from and opening through said upper surface, said chamber being adapted to receive ceramic objects, and said lid being adapted to rest on said upper surface and to extend across the opening to said recess in a closed position of said lid, said lid comprising a layer of ceramic material having a peripheral surface and major upper and lower surfaces defining the upper and lower surfaces of the lid, and comprising a binding member tensioned around said peripheral surface retaining the ceramic material in the layer and defining a periphery of the lid; the kiln including means for heating the chamber with the lower surface of the lid supported on the upper surface of the body to cure ceramic objects within the chamber, with such heating causing expansion of the ceramic lining including in the vertical direction;

said assembly comprising an anchor member having opposite upper and lower ends and opposite sides extending between said ends, said anchor member being adapted to be mounted on the side surface of the body of the kiln with said upper end adjacent the upper surface of the body and said sides spaced along and extending generally vertically along the outer side surface of the body;

a pivot pin having an axis and being mounted on the anchor member adjacent said upper end with said axis generally horizontal;

spaced hinge portions adapted to be attached to the periphery of said lid and having surfaces defining openings through said spaced hinge portions receiving and being pivotable about said pivot pin, said surfaces defining openings through said spaced hinge portions comprising, with said lid supported on said upper surface of the body, opposed generally vertically extending surfaces having sufficient length to afford vertical movement of said hinge portions and lid relative to said pivot pin to accommodate expansion of the ceramic lining during heating of the kiln by the heating means;

a force transfer structure including a pivot portion having a lower end part pivotably mounted on said pivot pin, said pivot portion being adapted to project from said pivot pin along the periphery of the lid and having an upper part adapted to be spaced above the upper surface of the lid, and a transverse portion attached to the upper part of said pivot portion, said transverse portion having a lid bridging part projecting from said upper part, adapted to be spaced above the upper surface of the lid, and having a distal end adapted to be positioned along the periphery of the lid at a location opposite said pivot portion, said transverse portion also having a force receiving part projecting from the side of said upper part opposite said lid bridging part and having a distal end spaced from said pivot portion;

mounting means adapted for mounting the distal end of said lid bridging part on the periphery of said lid at said location opposite said rear portion, which mounting means affords pivoting of said force transfer structure relative to said lid around an axis parallel to the axis of said pivot pin; and biasing means adapted for applying a force at said distal end of said force receiving part to assist manual lifting of said lid at said distal end portion of said lid bridging part or to lift said lid, such lifting pivoting said force transfer structure and said lid about said pivot pin to move said lid from said closed position to an open position spaced from said upper surface of the body.

2. An assembly according to claim 1 wherein said pivot pin has opposite end portions projecting from said side surfaces of said anchor member, said assembly includes a stabilizing part having opposite end portions each pivotably mounted on a different one of said projecting end portions of said pivot pin and a central portion fixed to the distal end of said force receiving part, said assembly includes a generally horizontal stop pin supported on said anchor member and having opposite end portions projecting from the side surfaces of said anchor member in a position adapted to be engaged by said opposite end portions of said stabilizing member upon movement of said lid to said open position with the lid spaced from said upper surface, in said open position of the lid said biasing means being adapted to apply a force sufficient to retain said end portions of said stabilizing part in engagement with said end portions of said stop pin in the absence of external forces applied to said lid.

3. An assembly according to claim 2 wherein said stop pin is of resiliently flexible material and is supported at spaced locations adjacent said projecting end portions on the upper end portion of the said anchor member so that engagement of said opposite end portions of said stabilizing member with said projecting opposite end portions of said stop pin will cause resilient deflection of said stop pin between said spaced locations to help absorb the momentum of the lid and thereby cushion its deceleration as it reaches said open position defined by the stop pin.

4. An assembly according to claim 2 where in said stop pin can be removed from said anchor member to afford movement of said stabilizing member and said force transfer structure to a position with said lid past said open position and further spaced from said upper surface than in said open position.

5. An assembly according to claim 1 wherein said pivot portion of said force transfer structure has opposite sides spaced axially of said pivot pin, and said transverse portion of said force transfer structure comprises two elongate rigid bridging members attached to said upper part of said pivot portion with portions of said bridging members on opposite sides of said pivot portion providing said lid bridging and force receiving parts of said transverse portion and having distal ends providing said distal ends of said lid bridging and force receiving parts.

6. An assembly according to claim 5 wherein said mounting means adapted for mounting the distal end of said lid bridging part on the periphery of said lid at said location opposite said rear portion comprises a bracket adapted to be attached to the periphery of the lid, said bracket having two spaced projections adapted to project from the periphery of the lid, and means for pivotably mounting the adjacent distal ends of said bridging members on said projections.

7. An assembly according to claim 6 wherein said means for pivotably mounting the adjacent distal ends of said bridging members on said projections comprises a pin extending through said projections and said adjacent distal ends of said bridging members, with a portion of said pin between said projections providing a handle adapted for manual engagement to move said lid from said closed to said open position.

8. An assembly according to claim 1 wherein said biasing means is a coil spring adapted to be tensioned between said distal end of said force receiving part and said anchor member.

9. A combination according to claim 1 wherein said biasing means is a weight on said distal end of said force receiving part.

10. In combination, a kiln having a body and a lid, and an assembly adapted for mounting the lid on the body of the kiln, said body having a normally vertically extending outer side surface and a normally horizontal upper surface and comprising a ceramic lining defining said upper surface and a chamber recessed from and opening through said upper surface, said chamber being adapted to receive ceramic objects, and said lid being adapted to rest on said upper surface and to extend across the opening to said recess in a closed position of said lid, said lid comprising a layer of ceramic material having a peripheral surface and major upper and lower surfaces defining the upper and lower surfaces of the lid, and comprising a binding member tensioned around said peripheral surface retaining the ceramic material in the layer and defining a periphery of the lid; the kiln including means for heating the chamber with the lower surface of the lid supported on the upper surface of the body to cure ceramic objects within the chamber, with such heating causing expansion of the ceramic lining including in the vertical direction;

said assembly comprising an anchor member having opposite upper and lower ends and opposite sides extending between said ends, said anchor member being mounted on the side surface of the body of the kiln with said upper end adjacent the upper surface of the body and said sides spaced along and extending generally vertically along the outer side surface of the body;

a pivot pin having an axis and being mounted on the anchor member adjacent said upper end with said axis generally horizontal;

spaced hinge portions attached to the periphery of said lid and having surfaces defining openings through said spaced hinge portions receiving and being pivotable about said pivot pin, said surfaces defining openings through said spaced hinge portions comprising, with said lid supported on said upper surface of the body, opposed generally vertically extending surfaces having sufficient length to afford vertical movement of said hinge portions and lid relative to said pivot pin to accommodate expansion of the ceramic lining during heating of the kiln by the heating means;

a force transfer structure including a pivot portion having a lower end part pivotably mounted on said pivot pin, said pivot portion being adapted to project from said pivot pin along the periphery of the lid and having an upper part adapted to be spaced above the upper surface of the lid, and a transverse portion attached to the upper part of said pivot portion, said transverse portion having a lid bridging part projecting from said upper part, spaced above the upper surface of the lid, and having a distal end positioned along the periphery of the lid at a location opposite said pivot portion, said transverse portion also having a force receiving part projecting from the side of said upper part opposite said lid bridging part and having a distal end spaced from said pivot portion;

mounting means for mounting the distal end of said lid bridging part on the periphery of said lid at said location opposite said rear portion, which mounting means affords pivoting of said force transfer structure relative to said lid around an axis parallel to the axis of said pivot pin; and biasing means for applying a force at said distal end of said force receiving part to assist manual lifting of said lid at said distal end portion of said lid bridging part or to lift said lid, such lifting pivoting said force transfer structure and said lid about said pivot pin to move said lid from said closed position to an open position spaced from said upper surface of the body.

11. A combination according to claim 10 wherein said pivot pin has opposite end portions projecting from said side surfaces of said anchor member, said assembly includes a stabilizing part having opposite end portions each pivotably mounted on a different one of said projecting end portions of said pivot pin and a central portion fixed to the distal end of said force receiving part, said assembly includes a generally horizontal stop pin supported on said anchor member and having opposite end portions projecting from the side surfaces of said anchor member in a position adapted to be engaged by said opposite end portions of said stabilizing member upon movement of said lid to said open position with the lid spaced from said upper surface, in said open position of the lid said biasing means applying a force sufficient to retain said end portions of said stabilizing part in engagement with said end portions of said stop pin in the absence of external forces applied to said lid.

12. A combination according to claim 11 wherein said stop pin is of resiliently flexible material and is supported at spaced locations adjacent said projecting end portions on the upper end portion of the said anchor member so that engagement of said opposite end portions of said stabilizing member with said projecting opposite end portions of said stop pin will cause resilient deflection of said stop pin between said spaced locations to help absorb the momentum of the lid and thereby cushion its deceleration as it reaches said open position defined by the stop pin.

13. A combination according to claim 11 where in said stop pin can be removed from said anchor member to afford movement of said stabilizing member and said force transfer structure to a position with said lid past said open position and further spaced from said upper surface than in said open position.

14. A combination according to claim 10 wherein said pivot portion of said force transfer structure has opposite sides spaced axially of said pivot pin, and said transverse portion of said force transfer structure comprises two elongate rigid bridging members attached to said upper part of said pivot portion with portions of said bridging members on opposite sides of said pivot portion providing said lid bridging and force receiving parts of said transverse portion and having distal ends providing said distal ends of said lid bridging and force receiving parts.

15. A combination according to claim 14 wherein said mounting means for mounting the distal end of said lid bridging part on the periphery of said lid at said location opposite said rear portion comprises a bracket attached to the periphery of the lid, said bracket having two spaced projections projecting from the periphery of the lid, and means for pivotably mounting the adjacent distal ends of said bridging members on said projections.

16. A combination according to claim 15 wherein said means for pivotably mounting the adjacent distal ends of said bridging members on said projections comprises a pin extending through said projections and said adjacent distal ends of said bridging members, with a portion of said pin between said projections providing a handle adapted for manual engagement to move said lid from said closed to said open position.

17. A combination according to claim 10 wherein said biasing means is a coil spring tensioned between said distal end of said force receiving part and said anchor member.

18. A combination according to claim 10 wherein said biasing means is a gas charged piston coupled between said distal end of said force receiving part and said anchor member.

19. A combination according to claim 10 wherein said biasing means is an air or hydraulically operated cylinder coupled between said distal end of said force receiving part and said anchor member and adapted to be activated by a user of the kiln to open or close the lid.

20. A combination according to claim 10 wherein said biasing means is a weight on said distal end of said force receiving part.

* * * * *